US012290184B1

(12) United States Patent
Smith et al.

(10) Patent No.: US 12,290,184 B1
(45) Date of Patent: May 6, 2025

(54) ADJUSTABLE BACK RESTAURANT HIGHCHAIR

(71) Applicants: Connor Smith, Kearney, NE (US); Samantha Smith, Kearney, NE (US)

(72) Inventors: Connor Smith, Kearney, NE (US); Samantha Smith, Kearney, NE (US)

( * ) Notice: Subject to any disclaimer, the term of this patent is extended or adjusted under 35 U.S.C. 154(b) by 137 days.

(21) Appl. No.: 18/097,278

(22) Filed: Jan. 15, 2023

(51) Int. Cl.
*A47D 1/00* (2006.01)

(52) U.S. Cl.
CPC ..... *A47D 1/002* (2013.01)

(58) Field of Classification Search
CPC ..... A47D 1/002; A47D 1/00; A47C 1/14
USPC ..... 297/357
See application file for complete search history.

(56) References Cited

U.S. PATENT DOCUMENTS 1,465,291 A * 8/1923 Walker ..... A47D 1/002 297/423.38
1,685,770 A * 10/1928 Bowen ..... B60N 2/0284 297/344.13
2,411,063 A * 11/1946 Scott ..... B60N 2/22 297/357
3,110,504 A * 11/1963 Myers ..... B62B 7/10 280/649
4,629,180 A * 12/1986 Kaya ..... A63B 23/0211 482/145
4,854,638 A 8/1989 Marcus et al.
5,372,405 A * 12/1994 Cash ..... B60N 2/58 297/229
5,603,682 A * 2/1997 Grider ..... A47C 7/40 482/142
6,334,652 B1 * 1/2002 Chen ..... A47D 13/105 297/256.13
6,416,124 B1 7/2002 Chen et al.
6,715,827 B1 4/2004 Chen
6,951,371 B2 10/2005 Wang
7,008,018 B2 3/2006 Chen
7,188,902 B1 * 3/2007 Chen ..... A61G 5/12 297/383
7,568,758 B2 8/2009 Troutman et al.
7,641,283 B2 1/2010 Rumack
7,832,801 B2 11/2010 Driessen
8,696,055 B2 4/2014 Stolarz et al.
(Continued)

FOREIGN PATENT DOCUMENTS

GB 2439280 A * 12/2007 ..... A47D 1/002
GB 2507834 A * 5/2014 ..... A47D 1/002

*Primary Examiner* — David R Dunn
*Assistant Examiner* — Tania Abraham
(74) *Attorney, Agent, or Firm* — Cramer Patent & Design, PLLC.; Aaron R. Cramer

(57) ABSTRACT

An adjustable back restaurant highchair is a restaurant style highchair with an adjustable back system. The back section of the highchair moves in its entirety, forward and backward along the seat section. Each corner of the seat back is provided with a pin that rides in four (4) corresponding adjustable tracks. Movement is enabled when a parent or care provider lifts the seat back up slightly, slides it forward or backward, and lowers it back into the tracks. Such adjustability accommodates children of all sizes, while ensuring that the smallest of them remain upright and cannot slide down. This eliminates the current practice of bracing the child up with towels, blankets, or coats, that are jammed in between their back and the seat support. The device remains stackable and keeps the simple design of its conventional counterpart.

13 Claims, 4 Drawing Sheets

(56) References Cited

U.S. PATENT DOCUMENTS

| | | | | |
|---|---|---|---|---|
| 9,827,505 | B2 * | 11/2017 | Najar | A63H 3/50 |
| 2007/0075579 | A1 * | 4/2007 | Babikian | A47D 1/00<br>297/448.1 |
| 2015/0130243 | A1 * | 5/2015 | Varney | A47C 1/026<br>297/354.12 |

* cited by examiner

ADJUSTABLE BACK RESTAURANT HIGHCHAIR

RELATED APPLICATIONS

None.

FIELD OF THE INVENTION

The present invention relates generally to a restaurant highchair and more specifically to a restaurant highchair having an adjustable back.

BACKGROUND OF THE INVENTION

The common restaurant style highchair with its trapezoidal side shape is a common sight at restaurants all over the country. Such chairs provide a stable and safe seating area for all sizes of children. They are also stackable to save space and are easy to clean and sanitize. However, one aspect of their use that many parents and care providers find lacking is the fixed seat back surface. While acceptable for larger and older children, such a seat back is often too far back for younger and smaller children. This allows the child to slouch down while eating or even fall to the side as their muscles and coordination are often not fully developed to remain upright.

To combat such problems, parents and care providers are known to stuff blankets, towels, tablecloths, and even coats behind the child's back to keep them upright. Unfortunately, in many cases, such items are not readily available, and even if they are, they are prone to slipping out over the course of a meal. Accordingly, there exists a need for a means by which children can be seated in a highchair without the disadvantages as described above. The development of the Adjustable Back Restaurant Highchair fulfills this need.

SUMMARY OF THE INVENTION

To achieve the above and other objectives, the present invention provides for an adjustable back restaurant highchair having a chair having a seat, a left side, and a right side, the chair is adapted for a child to sit on and to hold the child adjacent to a table in a restaurant, the left side and the right side each includes a pair of front legs, a pair of rear legs, a left arm rest, a right arm rest, and a seat brace, an adjustable back moved horizontally in a forward or rearward direction, the adjustable back is moveably coupled to the left side and the right side of the chair via a plurality of pegs, a front safety bar having a horizontally-oriented armature extending laterally from the left side to the right side at the front of the left arm rest and the right arm rest, and a front safety strap having a vertically-oriented flexible strap located at the front of the chair, the top of the front safety strap is coupled to the front safety bar.

The seat is a horizontal platform that may be coupled to the left side and the right side of the chair. The left side and the right side may be a plurality of vertically-oriented frame elements that hold the seat above the floor. The left arm rest may include a left side upper track and the seat brace on the left side includes a left side lower track. The left side lower track may be located directly below the left side upper track located on the rear half of the left arm rest and the left side lower track is located on the rear half of the seat brace of the left side. The adjustable back may be moveably coupled to the left side upper track, the right side upper track, the left side lower track and the right side lower track such that the adjustable back moves along the left side upper track, the right side upper track, the left side lower track, and the right side lower track.

Each of the left side upper track, the right side upper track, the left side lower track, and the right side lower track may include a horizontal slot and a plurality of notches. The notches may be U-shaped cut-outs extending downwards from the horizontal slot. The adjustable back may be adapted to adjust using one hand by lifting the adjustable back, moving the adjustable back forward or rearward, and lowering the adjustable back. The adjustable back may be a vertically-oriented backrest and is adapted for the child to lean back against. The right arm rest may include a right side upper track and the seat brace on the right side includes a right side lower track.

The right side lower track may be located directly below the right side upper track located on the rear half of the right arm rest and the right side lower track is located on the rear half of the seat brace of the right side. The pegs may include a left side upper peg coupled to the left upper side of the adjustable back and project laterally to the upper left of the adjustable back. The pegs may include a left side lower peg coupled to the left lower side of the adjustable back and projects laterally to the lower left of the adjustable back.

The adjustable back may be held in place by the left side upper peg and the left side lower peg on the left side of the adjustable back resting in one of the plurality of notches of the left side upper track and the left side lower track and by the right side upper peg and the right side lower peg on the left side of the adjustable back resting in one of the plurality of notches of the right side upper track and right side lower track. The pegs may include a right side upper peg coupled to the right upper side of the adjustable back and project laterally to the upper right of the adjustable back.

The pegs may include a right side lower peg coupled to the right lower side of the adjustable back and project laterally to the lower right of the adjustable back. The front safety bar may be adapted to prevent the child from sliding off of the front of the chair. The bottom of the front safety strap may be coupled to the front center of the seat. The front safety bar may be adapted to prevent the child from sliding under the front safety bar.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
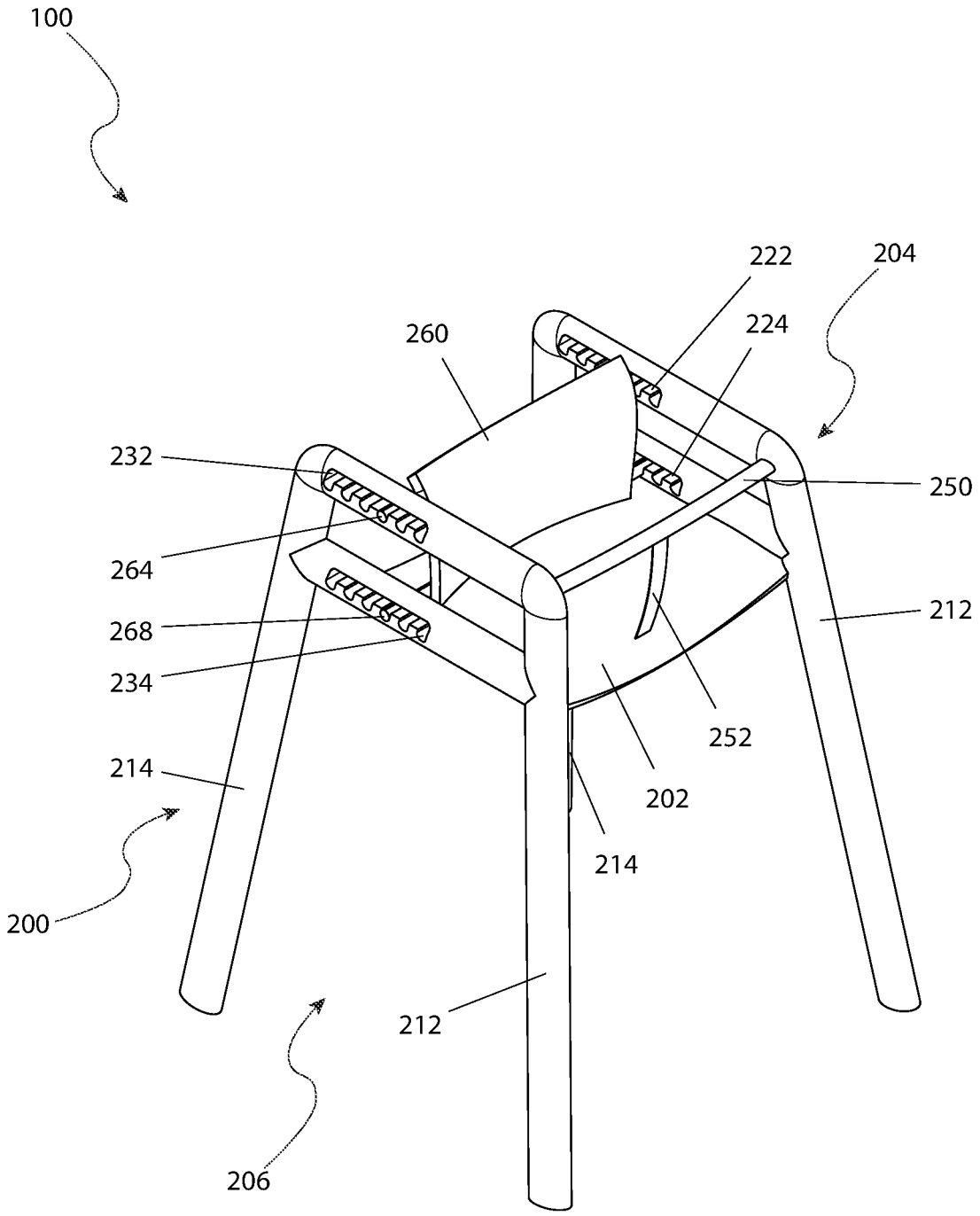
FIG. 1 is a front isometric view of an adjustable back restaurant highchair, according to an embodiment of the present invention.
Figure 2:
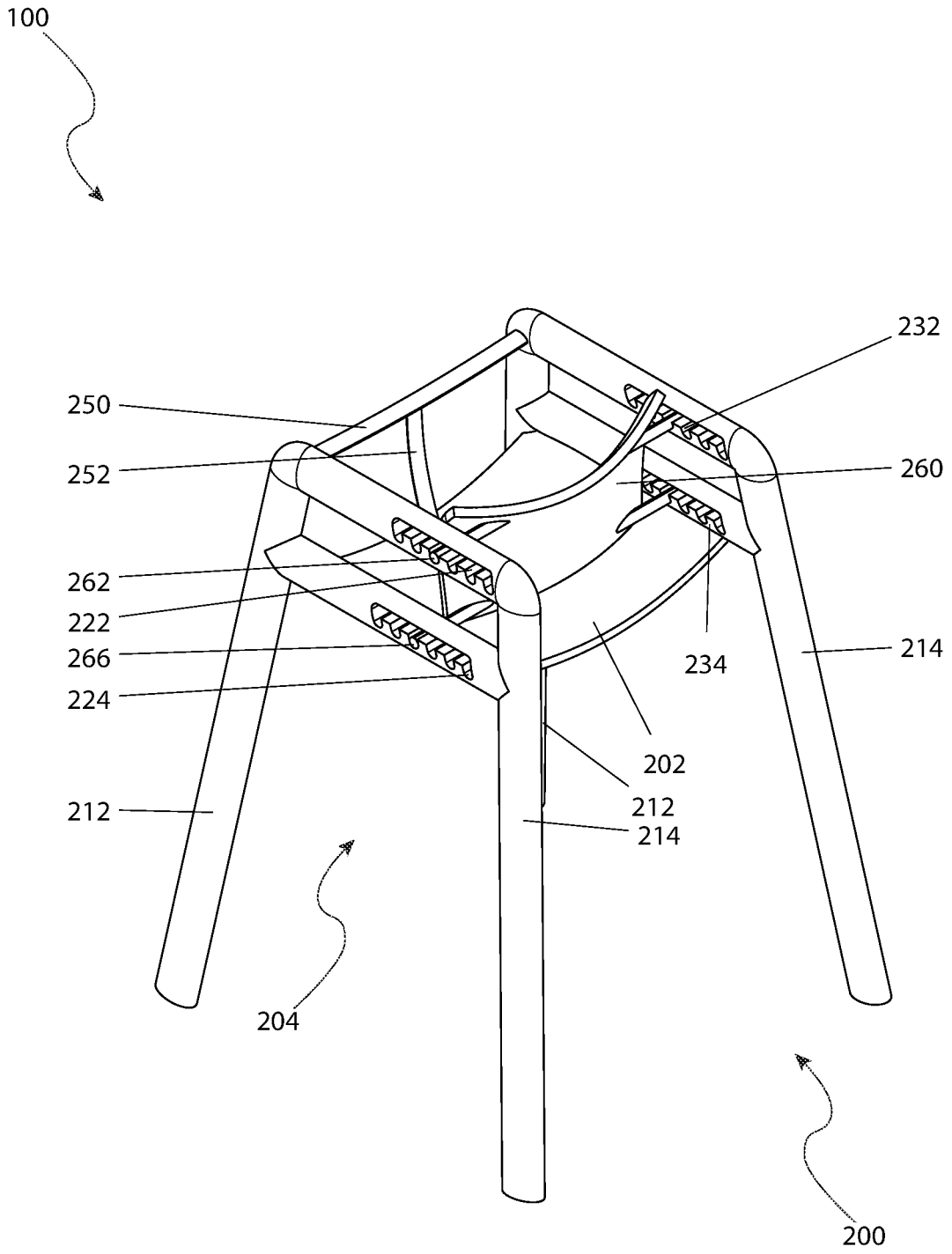
FIG. 2 is a rear isometric view of an adjustable back restaurant highchair, according to an embodiment of the present invention.
Figure 3:
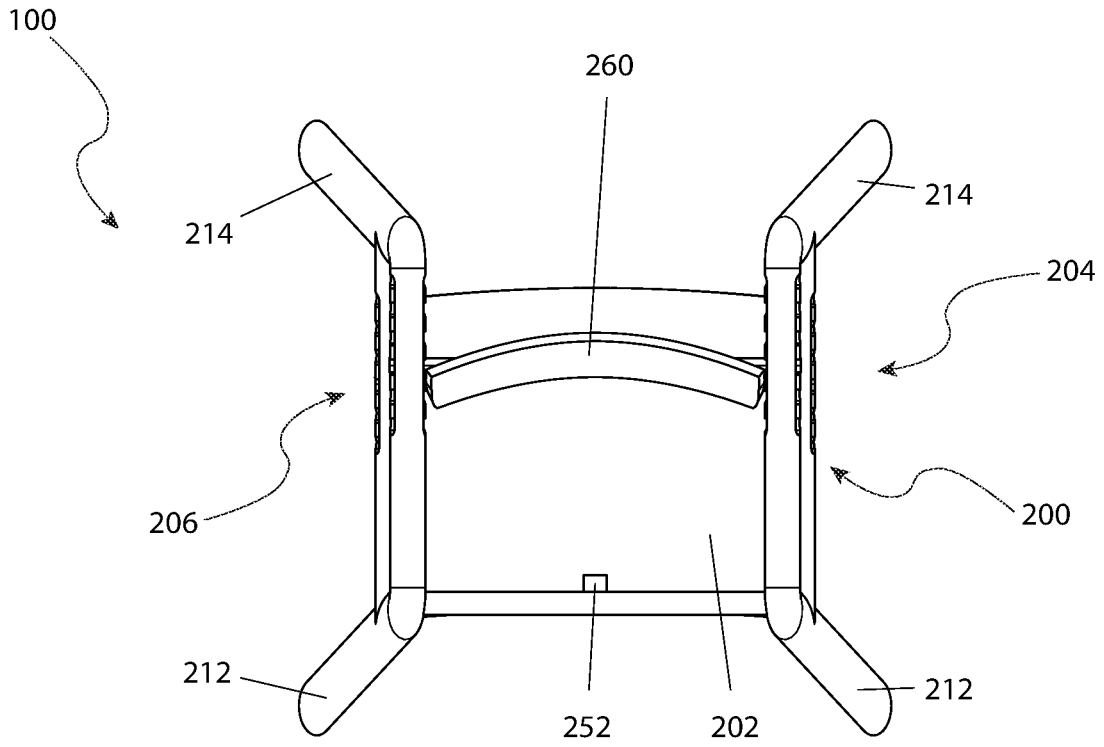
FIG. 3 is a top view of an adjustable back restaurant highchair, according to an embodiment of the present invention.
Figure 4:
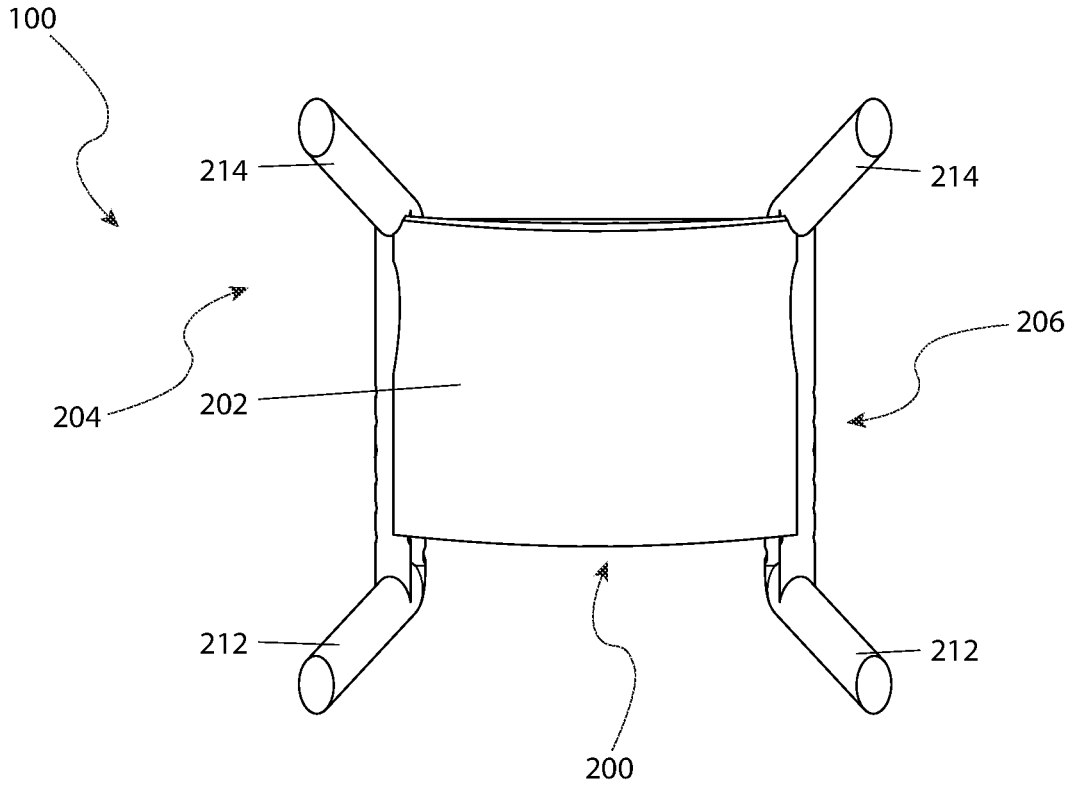
FIG. 4 is a bottom view of an adjustable back restaurant highchair, according to an embodiment of the present invention.
Figure 5:
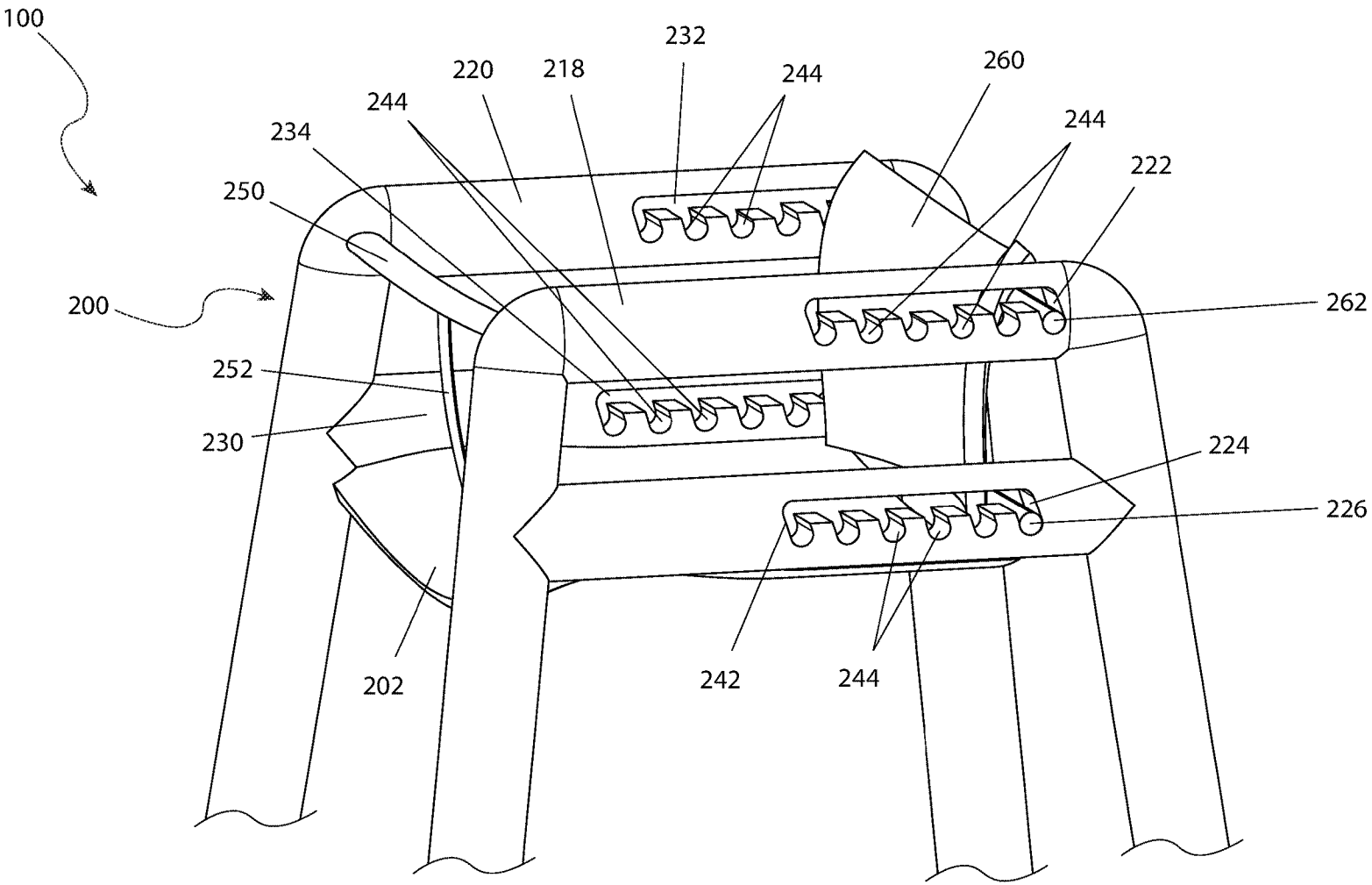
FIG. 5 is a detail view of an adjustable back restaurant highchair, according to an embodiment of the present invention.

100 adjustable back restaurant highchair
200 chair

202 seat
204 left side
206 right side
212 front leg
214 rear leg
218 left arm rest
220 right arm rest
222 left side upper track
224 left side lower track
230 seat brace
232 right side upper track
234 right side lower track
242 horizontal slot
244 notch
250 front safety bar
252 front safety strap
260 adjustable back
262 left side upper peg
264 right side upper peg
266 left side lower peg
268 right side lower peg 1. Description of the Invention The present invention is directed to an adjustable back restaurant highchair (herein described as the "invention") 100. The invention 100 may comprise a chair 200 and an adjustable back 260. The chair 200 may be adapted for a child to sit on. The chair 200 may be adapted to hold the child adjacent to a table in a restaurant. The adjustable back 260 may be moved horizontally in a forward or rearward direction to adjust the size of the invention 100. The adjustable back 260 may be adapted to adjust using one (1) hand by lifting the adjustable back 260, moving the adjustable back 260 forward or rearward, and lowering the adjustable back 260.

The chair 200 may comprise a seat 202, a left side 204, and a right side 206. The seat 202 may be a horizontal platform that may be coupled to the left side 204 and the right side 206. The left side 204 and the right side 206 may be vertically-oriented frame elements that hold the seat 202 above the floor.

An individual side selected from the left side 204 and the right side 206 may comprise a pair of front legs 212, a pair of rear legs 214, a left arm rest 218, a right arm rest 220, and a seat brace 230. The front legs 212 may be vertically-oriented and located at the front of the respective side 204, 206. The rear legs 214 may be vertically-oriented and located at the rear of the respective side 204, 206. The left arm rest 218 may be horizontally-oriented and located at the top of the left side 204. The right arm rest 220 may be horizontally-oriented and located at the top of the right side 206. The seat brace 230 may be horizontally-oriented and located below the arm rests 218, 220. The front of the left arm rest 218 may be coupled to the top of the front leg 212 of the left side 204. The rear of the left arm rest 218 may be coupled to the top of the rear leg 214 of the left side 204. The front of the right arm rest 220 may be coupled to the top of the front leg 212 of the right side 206. The rear of the right arm rest 220 may be coupled to the top of the rear leg 214 of the right side 206. The front of the seat brace 230 may be coupled to the front leg 212 of both sides 204, 206. The rear of the seat brace 230 may be coupled to the rear leg 214 of both sides 204, 206.

The left arm rest 218 may comprise a left side upper track 222. The seat brace 230 on the left side 204 may comprise a left side lower track 224. The left side lower track 224 may be located directly below the left side upper track 222. The left side upper track 222 may be located on the rear half of the left arm rest 218 and the left side lower track 224 may be located on the rear half of the seat brace 230 of the left side 204. The right arm rest 220 may comprise a right side upper track 232. The seat brace 230 on the right side 206 may comprise a right side lower track 234. The right side lower track 234 may be located directly below the right side upper track 232. The right side upper track 232 may be located on the rear half of the right arm rest 220 and the right side lower track 234 may be located on the rear half of the seat brace 230 of the right side 206. The adjustable back 260 may be moveably coupled to the left side upper track 222, right side upper track 232, left side lower track 224 and right side lower track 234 such that the adjustable back 260 may move along the left side upper track 222, right side upper track 232, left side lower track 224 and right side lower track 234.

Each of the left side upper track 222, the right side upper track 232, the left side lower track 224 and the right side lower track 234 may comprise a horizontal slot 242 and a plurality of notches 244. The notches 244 may be U-shaped cut-outs extending downwards from the horizontal slot 242. In the preferred embodiment the notches 244 will angle downward to prevent popping out.

A front safety bar 250 may be a horizontally-oriented armature extending laterally from the left side 204 to the right side 206 at the front of the left arm rest 218 and right arm rest 220. The front safety bar 250 may be adapted to prevent the child from sliding off of the front of the chair 200.

A front safety strap 252 may be a vertically-oriented flexible strap located at the front of the chair 200. The top of the front safety strap 252 may be coupled to the front safety bar 250. The bottom of the front safety strap 252 may be coupled to the front center of the seat 202. The front safety bar 250 may be adapted to prevent the child from sliding under the front safety bar 250.

The adjustable back 260 may be a vertically-oriented backrest. The adjustable back 260 may be adapted for the child to lean back against. The adjustable back 260 may be moveably coupled to the left side 204 and the right side 206 via a plurality of pegs 262, 264, 266, 268.

A left side upper peg 262 may be coupled to the left upper side of the adjustable back 260 and may project laterally to the upper left of the adjustable back 260. A left side lower peg 266 may be coupled to the left lower side of the adjustable back 260 and may project laterally to the lower left of the adjustable back 260. A right side upper peg 264 may be coupled to the right upper side of the adjustable back 260 and may project laterally to the upper right of the adjustable back 260. A right side lower peg 268 may be coupled to the right lower side of the adjustable back 260 and may project laterally to the lower right of the adjustable back 260.

As a non-limiting example, the adjustable back 260 may be held in place by the left side upper peg 262 and the left side lower peg 266 on the left side of the adjustable back 260 resting in one (1) of the plurality of notches 244 of the left side upper track 222 and left side lower track 224; and by the right side upper peg 264 and the right side lower peg 268 on the left side of the adjustable back 260 resting in one (1) of the plurality of notches 244 of the right side upper track 232 and right side lower track 234. The adjustable back 260 may be repositioned by lifting the adjustable back 260 to disengage all pegs 262, 264, 266, 268 from all notches 244, sliding the adjustable back 260 forward or rearward, and lowering the adjustable back 260 such that all pegs 262, 264, 266, 268 engage a different set of notches 244.

In some embodiments, all of the front legs 212 may slope rearward and all of the rear legs 214 may slope forward such that the bottom of the invention 100 is larger on a front-to-back direction than the top of the invention 100. The sloped legs 212, 214 may enable chairs 200 to stack on top of each other for storage with a lower chair 200 residing within the gap between the legs of an upper chair 200. The sloped legs 212, 214 may also increase the stability of the chair 200.

In some embodiments, the invention 100 may comprise other safety features such as a lap belt and/or a shoulder harness. The lap belt may be a flexible strap that may be coupled from the left side 204 to the right side 206. The lap belt may be adapted to lass over the lap of the child to prevent the child from climbing out of the chair 200. The lap belt may comprise a buckle for donning and removing the lap belt and a lapbelt length adjuster. The shoulder harness may be one or more flexible straps that may be coupled to the chair 200. The shoulder harness may be adapted to further restrain the child. The shoulder harness may pass over the shoulders of the child. The shoulder harness may comprise a buckle for donning and removing the shoulder harness and a harness length adjuster.

In use, the chair 200 may be positioned adjacent to a table at a restaurant. The adjustable back 260 be moved to a position that is appropriate for the size of the child by lifting the adjustable back 260, sliding the adjustable back 260 forward or rearward, and lowering the adjustable back 260. The child may be lowered into the chair 200 and other safety features such as the lap belt and the shoulder harness may be engaged, if present.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An adjustable back restaurant highchair, comprising:

a chair having a seat, a left side, and a right side, the chair is adapted for a child to sit on and to hold the child adjacent to a table in a restaurant, the left side and the right side each includes a front leg, a rear leg, an arm rest, and a seat brace;

an adjustable back moved horizontally in a forward or rearward direction, the adjustable back is moveably coupled to the left side and the right side of the chair via a plurality of pegs;

a front safety bar having a horizontally-oriented armature extending laterally from the left side to the right side at the front of the left arm rest and the right arm rest; and a front safety strap having a vertically-oriented flexible strap located at the front of the chair, the top of the front safety strap is coupled to the front safety bar and, wherein the left arm rest includes a left side upper track and the seat brace on the left side includes a left side lower track;

wherein the left side lower track is located directly below the left side upper track located on the rear half of the left arm rest and the left side lower track is located on the rear half of the seat brace of the left side;

wherein the adjustable back is moveably coupled to the left side upper track, the right side upper track, the left side lower track and the right side lower track such that the adjustable back moves along the left side upper track, the right side upper track, the left side lower track, and the right side lower track;

wherein each of the left side upper track, the right side upper track, the left side lower track, and the right side lower track includes a horizontal slot and a plurality of notches;

wherein the notches are U-shaped cut-outs extending downwards from the horizontal slot;

wherein the right arm rest includes a right side upper track and the seat brace on the right side includes a right side lower track; and, wherein the right side lower track is located directly below the right side upper track located on the rear half of the right arm rest and the right side lower track is located on the rear half of the seat brace of the right side.

2. The adjustable back restaurant highchair, according to claim 1, wherein the seat is a horizontal platform that is coupled to the left side and the right side of the chair.

3. The adjustable back restaurant highchair, according to claim 1, wherein the left side and the right side each comprise a plurality of vertically-oriented frame elements, the vertically-oriented frame elements being the pair of front legs and the pair of rear legs, which are configured to support the seat above the floor.

4. The adjustable back restaurant highchair, according to claim 1, wherein the adjustable back is adapted to adjust using one hand by lifting the adjustable back, moving the adjustable back forward or rearward, and lowering the adjustable back.

5. The adjustable back restaurant highchair, according to claim 1, wherein the adjustable back is a vertically-oriented backrest and is adapted for the child to lean back against.

6. The adjustable back restaurant highchair, according to claim 1, wherein the pegs include a left side upper peg coupled to the left upper side of the adjustable back and project laterally to the upper left of the adjustable back.

7. The adjustable back restaurant highchair, according to claim 1, wherein the pegs include a left side lower peg coupled to the left lower side of the adjustable back and projects laterally to the lower left of the adjustable back.

8. The adjustable back restaurant highchair, according to claim 1, wherein the adjustable back is held in place by the left side upper peg and the left side lower peg on the left side of the adjustable back resting in one of the plurality of notches of the left side upper track and the left side lower track, and by the right side upper peg and the right side lower peg on the right side of the adjustable back resting in one of the plurality of notches of the right side upper track and the right side lower track.

9. The adjustable back restaurant highchair, according to claim 1, wherein the pegs include a right side upper peg coupled to the right upper side of the adjustable back and project laterally to the upper right of the adjustable back.

10. The adjustable back restaurant highchair, according to claim 1, wherein the pegs include a right side lower peg coupled to the right lower side of the adjustable back and project laterally to the lower right of the adjustable back.

11. The adjustable back restaurant highchair, according to claim 1, wherein the front safety bar is adapted to prevent the child from sliding off of the front of the chair.

12. The adjustable back restaurant highchair, according to claim 1, wherein the bottom of the front safety strap is coupled to the front center of the seat.

13. The adjustable back restaurant highchair, according to claim 1, wherein the front safety bar is adapted to prevent the child from sliding under the front safety bar.

* * * * *